US005875983A

United States Patent [19]

Stuckey et al.

[11] Patent Number: 5,875,983

[45] Date of Patent: Mar. 2, 1999

[54] DETECTABLE BOBBIN AND CORE

[75] Inventors: William C. Stuckey, Hendersonville; Robert A. Spicuzza, Fletcher, both of N.C.

[73] Assignee: Barbour Threads, Inc., Henderson, N.C.

[21] Appl. No.: 801,566

[22] Filed: Feb. 18, 1997

[51] Int. Cl.[6] ..... B65H 75/10; B65H 55/00

[52] U.S. Cl. ..... 242/118.32; 242/173

[58] Field of Search ..... 242/118.32, 118.31, 242/118.3, 172, 173, 20; 156/169, 172, 306.9

[56] References Cited

U.S. PATENT DOCUMENTS

| | | | |
|---|---|---|---|
| 1,516,002 | 11/1924 | Curry | 242/173 |
| 1,570,534 | 1/1926 | Sweeney et al. | 242/118.3 |
| 2,200,720 | 5/1940 | Morin et al. | 242/173 |
| 2,906,473 | 9/1959 | Crawley | 242/118.32 |
| 3,061,888 | 11/1962 | Wadham | 264/437 |
| 3,716,202 | 2/1973 | Thomas | 242/118.32 X |
| 4,100,866 | 7/1978 | Philips | 242/118.3 |
| 4,244,313 | 1/1981 | Rovin et al. | 242/20 |
| 4,390,144 | 6/1983 | Mueller | 242/118.32 X |

*Primary Examiner*—Michael Mansen
*Attorney, Agent, or Firm*—Rhodes Coats & Bennett, L.L.P.

[57] ABSTRACT

A magnetically detectable bobbin for a sewing machine. The apparatus includes a substantially non-metallic detectable bobbin core. The core includes a substantially non-metallic cylindrical body having a detectable dopant in the cylindrical body. In the preferred embodiment, the dopant is magnetite. The thread supply is wound about the bobbin core after a frictional outer surface is applied to the bobbin core to aid in windability of the thread supply.

58 Claims, 1 Drawing Sheet

DETECTABLE BOBBIN AND CORE

BACKGROUND OF THE INVENTION (1) Field of the Invention

The present invention relates generally to pre-wound sewing machine bobbins and, more particularly, to a detectable bobbin and core for use in critical applications such as manufacturing air bags.

(2) Description of the Prior Art

A lockstitch sewing machine requires the use of a bobbin to provide the underthread which interlaces with the top thread supplied by the sewing needle to produce a seam. Historically these bobbins have been wound at the sewing machine on metal shells initially supplied by the sewing machine manufacturer. These self-wound bobbins typically do not provide the highest productivity and quality demanded by the sewn products industry. Specifically, it takes more time to hand wind a bobbin than to use a pre-wound bobbin and a handwound bobbin usually only holds about ½ the amount of thread as a pre-wound bobbin due to better packing using automatic machinery.

These pre-wound bobbins are normally composed of an appropriate sewing thread wound on a plastic or paper cylindrical core with overall dimensions (i.e., thickness, inside diameter and outside diameter) required by a given sewing machine. Manufacturing of a pre-wound bobbin requires a sturdy core with a frictional surface that ensures correct and dependable windability. Pre-wound bobbins provide higher quality and productivity by virtue of greater thread capacity, uniform thread lengths and reproducible pull-off tension compared to self-wound bobbins.

In some applications (e.g., air bag manufacturing), there is a need to ensure that there are no extraneous materials inadvertently left inside the completed assembly. To ensure that an accidently misplaced bobbin or bobbin core is found and removed, there is a need for these items to be detectable by non-destructible means. Current versions of pre-wound bobbins and associated bobbin cores are unacceptable for these applications because they cannot be detected.

One unacceptable method for achieving this detection capability is to self-wind bobbins utilizing the original metal shell provided with the sewing machine. Although easily detected, these self-wound bobbins yield lower productivity and quality than required as discussed above. Additionally, there is a very high liability risk associated with a metal shell that is accidentally undetected. In the case of an air bag, the weight of the metal shell is sufficient to produce a very dangerous projectile with high kinetic energy under the rapid deployment of the air bag.

Thus, there remains a need for a new and improved bobbin for a sewing machine which may be easily detected if accidentally left in the sewn article, such as an air bag while, at the same time, can be easily pre-wound using automatic equipment.

SUMMARY OF THE INVENTION

The present invention is directed to a detectable bobbin for a sewing machine. The apparatus includes a substantially non-metallic detectable bobbin core. The core includes a substantially non-metallic cylindrical body having a detectable dopant in the cylindrical body. In the preferred embodiment, the dopant is magnetite. A thread supply is wound about the bobbin core after a frictional outer surface is applied to the bobbin core to aid in windability of the thread supply. Thus, the bobbin may be easily detected if accidentally left in the sewn article while, at the same time, can be easily pre-wound using automatic equipment.

Accordingly, one aspect of the present invention is to provide a detectable bobbin for a sewing machine. The apparatus includes: (a) a substantially non-metallic detectable bobbin core; and (b) a thread supply wound about the bobbin core.

Another aspect of the present invention is to provide a detectable bobbin core for a sewing machine. The apparatus includes: (a) a substantially non-metallic cylindrical body; and (b) a detectable dopant in the cylindrical body.

Still another aspect of the present invention is to provide a detectable bobbin for a sewing machine. The apparatus includes: (a) a substantially non-metallic detectable bobbin core, the core including: (i) a substantially non-metallic cylindrical body; and (ii) a detectable dopant in the cylindrical body; (b) a thread supply wound about the bobbin core; and (c) a frictional outer surface applied to the bobbin core to aid in windability of the thread supply.

These and other aspects of the present invention will become apparent to those skilled in the art after a reading of the following description of the preferred embodiment when considered with the drawings.

DESCRIPTION OF THE PREFERRED EMBODIMENTS

Figure 2:
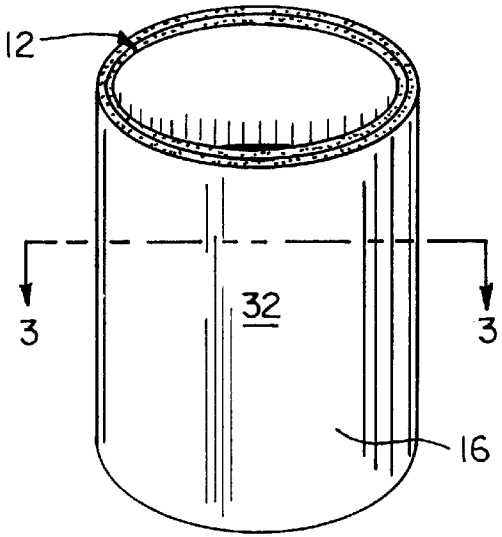
FIG. 2 is a perspective view of a detectable core for the bobbin shown in FIG. 1.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Figure 1:
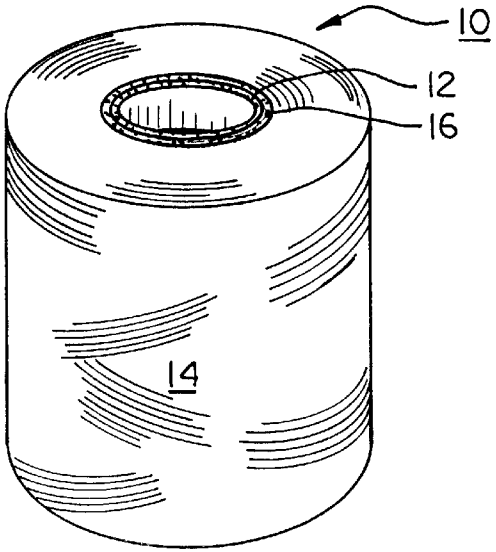
FIG. 1 is a perspective view illustrating a bobbin constructed according to the present invention.

Referring now to the drawings in general and FIG. 1 in particular, it will be understood that the illustrations are for the purpose of describing a preferred embodiment of the invention and are not intended to limit the invention thereto. As best seen in FIG. 1, a bobbin, generally designated 10, is shown constructed according to the present invention. The bobbin 10 includes three major subparts: a detectable core 12; a thread supply 14; and a frictional surface 16.

Typically, the thread supply is composed of a continuous multifilament thread although people skilled in the art will recognize that other type threads can be used. Polyester threads and nylon threads are preferred. The thread supply 14 also may include a tacking agent, preferably a polyamide resin, to provide uniform pull-off tension to aid in sewing.

As can be seen in FIG. 2, the detectable core 12 has a cylindrical body 20 and a first detectable dopant 22. It is preferred that the cylindrical body be constructed of paper or plastic, specifically thermoplastic. The first detectable dopant 22 is preferably magnetically susceptible, and therefore would typically consist of metal particles, metal oxides, such as magnetite, 34 or metal wire. As will be seen in the table below, there should be at least about 10 mg. of the magnetically susceptible material in order for the bobbin 10 to be easily detectable. It is preferred that about 40 mg. of detectable dopant 22 be provided in the bobbin 10.

Figure 3B:
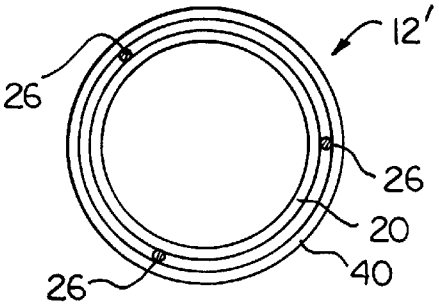
FIGS. 3A and 3B are cross-sectional views of alternative embodiments of the detectable core shown in FIG. 2 taken along line 3—3.
Figure 3A:
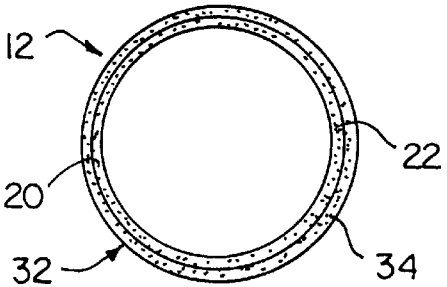

As can be seen in FIG. 3A, one of the preferred embodiments of the detectable core 12 consists of a polypropylene cylindrical body 20 encased in an elastomeric sheath, such as Kraton® thermoplastic rubber 32 (available, for example, from Teel Plastics Co. Inc. of Baraboo, Wis. This elastomeric sheath 32 is co-extruded with the cylindrical body 20 and consists within it a second detectable dopant, such as magnetite, 34 of greater than about 2 mg. The first detectable dopant 22 may be impregnated within the material and the underlying core 12. As will be discussed below, the total weight of the first and second detectable dopants is preferred to be greater than about 10 mg.

As can be seen in FIG. 3B, an alternative embodiment of the present invention 12' has a cylindrical body 20 constructed of paper. The outer surface of the cylindrical body 20 is a textured paper 40. In this embodiment, the first detectable dopant 22 can be a metal wire, preferably constructed of mild steel.

As illustrated in the table set forth below, it has been discovered that the total detectable dopant should be greater than about 10 mg. of magnetically susceptible particles in order to be detected by current methods. Further, the surface of the detectable core 12 should allow for the thread to be properly wound using an automatic bobbin winder.

The present invention can best be understood after a review of the following examples.

TABLE

| Ex. | Description | Total Wt. (mg) | Dopant Wt. (mg) | Detect | Wind |
|---|---|---|---|---|---|
| 1 | Metal Bobbin (prior art) | 15,000 | 15,000 | Y+ | N |
| 2 | Paper Core (prior art) | 120 | 0 | N | Y |
| 3 | Plastic Core (prior art) | 160 | 0 | N | N |
| 4 | Plastic Core w/sheath (prior art) | 160 | 0 | N | Y |
| 5 | Paper Core w/metallic paint | 121 | 1 | N | Y |
| 6 | Plastic Core w/metallized sheath | 162 | 2 | N | Y+ |
| 7 | Plastic Core w/impregnated magnetite w/metallized sheath | 170 | 10 | Y− | Y+ |
| 8 | Paper Core w/encased wire | 160 | 40 | Y+ | Y− |
| 9 | Metal Core | 1000 | 1000 | Y+ | N |

In the above examples "Y" means performed satisfactory and "N" means did not perform satisfactory. The addition of "+" or "−" means slightly better or worse than satisfactory. As can be seen only examples 7 and 8 having greater than about 10 mg. of magnetite and either a sheath or a paper frictional surface passed both tests. However, example 6 may perform satisfactory if the amount of magnetite is further increased to greater than about 10 mg.

In operation, the thread supply 14 is wound onto the detectable core 12 according to conventional methods. After the thread supply 14 is exhausted in a conventional sewing operation, such as in the sewing of air bags, the detectable core 12, including any leftover thread is discarded. If the detectable core 12 is accidentally left in the sewn article, such as an air bag, it will be capable of being detected by conventional methods, such as a metal detector.

Certain modifications and improvements will occur to those skilled in the art upon a reading of the foregoing description. By way of example, a satisfactory frictional surface could be directly imparted to the outer surface of a doped plastic tube by chemical or mechanical treatment. Also, while a metal wire has been described in one embodiment, the wire could be replaced with a foil strip 26. It should be understood that all such modifications and improvements have been deleted herein for the sake of conciseness and readability but are properly within the scope of the following claims.

We claim:

1. A flangeless detectable bobbin for a sewing machine, said apparatus comprising:

(a) a substantially non-metallic magnetically detectable bobbin core; and (b) a thread supply wound about said bobbin core.

2. The apparatus according to claim 1, further including a frictional outer surface applied to said bobbin core to aid in windability of said thread supply.

3. The apparatus according to claim 2, wherein said frictional outer surface is formed from textured paper.

4. The apparatus according to claim 2, wherein said frictional outer surface is formed from treated plastic.

5. The apparatus according to claim 2, wherein said frictional outer surface is formed from an elastomeric material.

6. The apparatus according to claim 5, wherein said frictional outer surface is formed from an elastomeric material.

7. The apparatus according to claim 5, wherein said frictional outer surface is formed from thermoplastic rubber.

8. The apparatus according to claim 5, wherein said frictional outer surface further includes a detectable dopant.

9. The apparatus according to claim 8, wherein said detectable dopant is a magnetically susceptible material.

10. The apparatus according to claim 9, wherein said magnetically susceptible material is metal particles.

11. The apparatus according to claim 9, wherein said magnetically susceptible material is a metal oxide.

12. The apparatus according to claim 11, wherein said metal oxide is magnetite.

13. The apparatus according to claim 9, wherein said magnetically susceptible material is greater than about 2 mg.

14. The apparatus according to claim 1, wherein said thread supply is a continuous multi-filament yarn.

15. The apparatus according to claim 14, wherein said continuous multi-filament yarn is polyester.

16. The apparatus according to claim 14, wherein said continuous multi-filament yarn is nylon.

17. The apparatus according to claim 14, further including a tacking agent to aid in controlling pull-off tension.

18. The apparatus according to claim 17, wherein said tacking agent is a polyamide resin.

19. A flangeless detectable bobbin core for a sewing machine, said apparatus comprising:

(a) a substantially non-metallic magnetically cylindrical body; and (b) a detectable dopant in said cylindrical body.

20. The apparatus according to claim 19, wherein said cylindrical body is formed from paper.

21. The apparatus according to claim 19, wherein said cylindrical body is formed from plastic.

22. The apparatus according to claim 21, wherein said plastic is a thermoplastic.

23. The apparatus according to claim 22, wherein said thermoplastic is polypropylene.

24. The apparatus according to claim 19, wherein said detectable dopant is a magnetically susceptible material.

25. The apparatus according to claim 24, wherein said magnetically susceptible material is metal particles.

26. The apparatus according to claim 24 wherein said magnetically susceptible material is a metal oxide.

27. The apparatus according to claim 26, wherein said metal oxide is magnetite.

28. The apparatus according to claim 24 wherein said magnetically susceptible material is at least one metal foil strip.

29. The apparatus according to claim 24, wherein said magnetically susceptible material is greater than about 10 mg.

30. The apparatus according to claim 29, wherein said magnetically susceptible material is about 40 mg.

31. A flangeless detectable bobbin for a sewing machine, said apparatus comprising:

(a) a substantially non-metallic magnetically detectable bobbin core, said core including: (i) a substantially non-metallic cylindrical body; and (ii) a first magnetically detectable dopant in said cylindrical body;

(b) a thread supply wound about said bobbin core; and (c) a frictional outer surface applied to said bobbin core to aid in windability of said thread supply.

32. The apparatus according to claim 31, wherein said cylindrical body is formed from paper.

33. The apparatus according to claim 31, wherein said frictional outer surface is formed from textured paper.

34. The apparatus according to claim 31, wherein said frictional outer surface is formed from treated plastic.

35. The apparatus according to claim 31, wherein said frictional outer surface is formed from an elastomeric material.

36. The apparatus according to claim 35, wherein said frictional outer surface is formed from an elastomeric material.

37. The apparatus according to claim 35, wherein said frictional outer surface is formed from thermoplastic rubber.

38. The apparatus according to claim 35, wherein said frictional outer surface further includes a second detectable dopant.

39. The apparatus according to claim 38, wherein said second detectable dopant is a magnetically susceptible material.

40. The apparatus according to claim 39, wherein said magnetically susceptible material is metal particles.

41. The apparatus according to claim 39, wherein said magnetically susceptible material is a metal oxide.

42. The apparatus according to claim 41, wherein said metal oxide is magnetite.

43. The apparatus according to claim 39, wherein said magnetically susceptible material is greater than about 2 mg.

44. The apparatus according to claim 31, wherein said thread supply is a continuous multi-filament yarn.

45. The apparatus according to claim 44, wherein said continuous multi-filament yarn is polyester.

46. The apparatus according to claim 44, wherein said continuous multi-filament yarn is nylon.

47. The apparatus according to claim 44, further including a tacking agent to aid in controlling pull-off tension.

48. The apparatus according to claim 47, wherein said tacking agent is a polyamide resin.

49. The apparatus according to claim 31, wherein said cylindrical body is formed from plastic.

50. The apparatus according to claim 49, wherein said plastic is a thermoplastic.

51. The apparatus according to claim 50, wherein said thermoplastic is polypropylene.

52. The apparatus according to claim 31, wherein said detectable dopant is a magnetically susceptible material.

53. The apparatus according to claim 52, wherein said magnetically susceptible material is metal particles.

54. The apparatus according to claim 52 wherein said magnetically susceptible material is a metal oxide.

55. The apparatus according to claim 54, wherein said metal oxide is magnetite.

56. The apparatus according to claim 52 wherein said magnetically susceptible material is at least one metal foil strip.

57. The apparatus according to claim 52, wherein said magnetically susceptible material is greater than about 10 mg.

58. The apparatus according to claim 57, wherein said magnetically susceptible material is about 40 mg.

* * * * *